US008857665B2

(12) United States Patent
Owoc

(10) Patent No.: US 8,857,665 B2
(45) Date of Patent: Oct. 14, 2014

(54) BEVERAGE CONTAINER WITH SECONDARY INTERNAL DISPENSING CHAMBER

(71) Applicant: John H. Owoc, Weston, FL (US)

(72) Inventor: John H. Owoc, Weston, FL (US)

( * ) Notice: Subject to any disclaimer, the term of this patent is extended or adjusted under 35 U.S.C. 154(b) by 0 days.

(21) Appl. No.: 13/677,987

(22) Filed: Nov. 15, 2012

(65) Prior Publication Data

US 2013/0119087 A1 May 16, 2013

Related U.S. Application Data

(60) Provisional application No. 61/560,011, filed on Nov. 15, 2011.

(51) Int. Cl.

| | |
|---|---|
| ***B67D 7/74*** | (2010.01) |
| ***B65D 51/28*** | (2006.01) |
| ***B65D 23/00*** | (2006.01) |
| ***B67D 99/00*** | (2010.01) |

(52) U.S. Cl.

CPC ..... *B65D 23/00* (2013.01); *B65D 51/2892* (2013.01); *B67D 99/00* (2013.01); *Y10S 215/08* (2013.01)

USPC ..... 222/129; 222/1; 222/145.1; 222/145.5; 206/219; 206/221; 215/DIG. 8

(58) Field of Classification Search

USPC ..... 222/129, 145.5–145.6, 145.1, 1; 206/219, 221; 215/220, DIG. 8

See application file for complete search history.

(56) References Cited

U.S. PATENT DOCUMENTS

| | | | | |
|---|---|---|---|---|
| 3,347,410 | A * | 10/1967 | Schwartzman | 222/80 |
| 4,315,570 | A | 2/1982 | Silver et al. | |
| 5,246,142 | A | 9/1993 | DiPalma et al. | |
| 5,839,573 | A * | 11/1998 | Morini | 206/221 |
| 6,003,728 | A | 12/1999 | Elliott | |
| 6,257,428 | B1 | 7/2001 | Caola | |
| 6,435,341 | B1 * | 8/2002 | Nobbio | 206/219 |
| 6,840,373 | B2 * | 1/2005 | Gibler et al. | 206/219 |
| 7,070,046 | B2 | 7/2006 | Cho | |
| 7,175,049 | B2 * | 2/2007 | Kastenschmidt et al. | 222/81 |
| 7,568,576 | B2 * | 8/2009 | Sweeney et al. | 206/219 |
| 7,861,855 | B2 | 1/2011 | Casey | |
| 7,874,420 | B2 | 1/2011 | Coon | |
| 7,909,210 | B2 | 3/2011 | Roth et al. | |
| 7,951,109 | B2 | 5/2011 | Anderson | |
| 8,430,137 | B2 * | 4/2013 | Sim | 141/322 |
| 8,443,970 | B2 * | 5/2013 | Coon | 206/222 |
| 8,479,943 | B2 * | 7/2013 | Wilhelm | 220/267 |
| 8,490,786 | B2 * | 7/2013 | Rohr et al. | 206/221 |

(Continued)

*Primary Examiner* — Frederick C Nicolas

(74) *Attorney, Agent, or Firm* — Allen F. Bennett

(57) ABSTRACT

An internal chamber incorporated with the cap of a container, for example, a disposable beverage bottle. The internal chamber has an internal bore designed to hold a powder or liquid that can be released into the container. The chamber is inserted into a bottle or similar container when the cap is placed over the opening. A push-button on the top of the cap advances an actuator within the internal bore to push a diaphragm out of the distal end outlet port in the chamber to release the ingredient(s) within the internal chamber into the container. The diaphragm also has two or more peripheral guide rails to ensure that it remains aligned with the chamber housing during those movements. Alternative embodiments utilize a dome cover over the push-button. In use, the cap of the container can be removed, which will simultaneously remove the chamber, allowing the liquid in the container to be consumed or decanted.

27 Claims, 15 Drawing Sheets

(56) References Cited

U.S. PATENT DOCUMENTS

| | | | | |
|---|---|---|---|---|
| 2004/0154937 | A1 | 8/2004 | Cho | |
| 2005/0115845 | A1 | 6/2005 | Cho | |
| 2006/0118435 | A1 | 6/2006 | Cronin et al. | |
| 2007/0284265 | A1 | 12/2007 | Parker | |
| 2008/0028948 | A1 | 2/2008 | Kirschner et al. | |
| 2008/0073307 | A1 | 3/2008 | Sweeney et al. | |
| 2008/0099487 | A1 | 5/2008 | Winn | |
| 2009/0120528 | A1 | 5/2009 | Fisher et al. | |
| 2009/0133366 | A1 | 5/2009 | Cronin et al. | |
| 2009/0236244 | A1 | 9/2009 | Frutin | |
| 2009/0301905 | A1 | 12/2009 | Bullard et al. | |
| 2010/0024454 | A1 | 2/2010 | Kawano et al. | |
| 2010/0044254 | A1 | 2/2010 | Romeo | |
| 2010/0163509 | A1 | 7/2010 | Canziani Hoffa et al. | |
| 2011/0000800 | A1* | 1/2011 | Rohr et al. | 206/219 |
| 2012/0217178 | A1* | 8/2012 | Rohr et al. | 206/219 |

* cited by examiner

BEVERAGE CONTAINER WITH SECONDARY INTERNAL DISPENSING CHAMBER

CROSS-REFERENCE TO RELATED APPLICATION

The present application claims the benefit of U.S. Provisional Application Ser. No. 61/560,011, filed Nov. 15, 2011, which is hereby incorporated by reference herein in its entirety, including any figures, tables, or drawings.

BACKGROUND OF INVENTION

The beverage industry is a multi-billion dollar business with sales around the world. The most popular non-alcoholic beverages have been water, tea, and coffee. But, increased consumer demands for more specialized drinks have caused the industry to grow in new directions in the past several years. In addition to a variety of soft drinks and fruit-flavored drinks, many other types of beverages, such as those for sport, health, energy, and diet needs, have all experienced an increase in popularity. Many of these drinks contain ingredients such as electrolytes, carbohydrates, salts, vitamins, minerals, amino acids, stimulants, diet supplements, neutraceuticals, and other ingredients that are added to the beverage to increase or enhance physical or mental response and performance. Some ingredients are added simply to increase consumer enjoyment of a beverage, such as flavorings, colorings, carbonation, and/or sweetness.

There are also ingredients and mixtures that are available as secondary components in powder, granular, gel, liquid or other forms that can be mixed with water or another beverage. This allows the consumer to carry a smaller container, envelope, or other compact package and mix the contents with water or other beverage of choice. In some cases, this is preferred because not all secondary components, for various reasons, are effective or palatable if pre-mixed. For example, whey powder is a common dietary supplement often utilized as a secondary component. While it mixes well with water and most beverages, it does not stay in solution very well and usually settles out of the beverage. Consumers can shake the container to redistribute the whey powder in the water or beverage, but this often produces an incompletely dissolved or lumpy consistency. Some secondary components may also become less effective if maintained for a length of time in a liquid solution. Also, some vitamins and neutraceuticals can lose effectiveness over time when exposed to light, which can happen with many beverages stored in clear containers.

Many of the beverages that are sold today are stored, shipped and consumed from single-use disposable containers, such as bottles, cans, and cartons. Disposable containers are convenient, recyclable, sanitary, and are available in a variety of sizes. However, the typical single-use container opening is sized to facilitate drinking and is usually not large enough to conveniently introduce secondary components into the container. Further, single-use beverage containers are often filled to a maximum capacity that limits the amount of secondary component that can be added to the bottle and adequately mixed with the contents. Yet another consideration is the fact that the consumer must carry a separate beverage container or obtain a beverage in which to mix a secondary component.

There is a need for a bottle or container that can conveniently store or hold a secondary component separate and protected from a liquid or other substance within the container, but which allows a secondary component to be easily added and mixed with the substance in the container at the desired time. Such a container should maintain convenience to the consumer, adequately protect the secondary component from contact with the container substance, light, or other harmful exposure, until mixing is desired, and should be easy to use by all consumers. Ideally, the container would be recyclable and useful with a variety of substances, including beverages, and compatible secondary components.

BRIEF SUMMARY

The embodiments of the subject invention successfully address the above described disadvantages associated with the previously known containers and their methods of use, and provide certain attributes and advantages, which have not been realized by those known containers. The embodiments of the subject invention provide novel, inexpensive, and highly effective devices and methods for storing and mixing secondary components with a substance inside a container.

In particular, with the embodiments of the subject invention, the problem of storing and adding a secondary component to a substance within a container is solved by storing the secondary component within an interior chamber held within the container. The interior chamber can be opened when desired to release the secondary component into the container, so that it can be mixed with a substance within the container.

The advantages of a container with an internal chamber, which will become apparent from the following disclosure, reside in the secondary component being securely stored within the container, protected from a container substance, allowing addition of the secondary component to the chamber substance with minimal or no contact with the outside of the container. Other advantages include the convenience of storing, carrying, or otherwise having to handle only a single container and the ability to package a pre-measured and exact amount of secondary components required for the amount of container substance.

Embodiments of the container of the subject invention are designed to include an interior chamber formed as part of, attached to, or otherwise cooperatively engaged with the container closure mechanism. Alternative embodiments provide an interior chamber cooperatively engaged with the container. A control mechanism on the closure mechanism or another location on the outside of the container can be activated, which opens the interior chamber and releases the secondary component into the container. Once the secondary component has been released into the container, the container can be shaken, if necessary, to evenly distribute, dissolve, or incorporate the secondary component. Because the cap remains in place, there is no spilling or splashing of the contents out of the container when it is shaken. Embodiments of the container of the subject invention include simultaneous removal of the closure mechanism and the interior chamber in order to dispense the contents of the container. Other embodiments allow the interior chamber to remain in place during dispensing. Still further embodiments include one or more additional openings from which the container contents can be consumed, poured, or used, allowing the closure mechanism and/or interior chamber to remain in place.

Embodiments of the container of the subject invention can also include such features as tamper evident seals; flip top, pull top or other reclosable openings; interior chambers with various shapes for particular uses or aesthetic purposes;

mechanisms for preventing accidental opening of the interior chamber; and other features that will be apparent to those with skill in the art.

BRIEF DESCRIPTION OF DRAWINGS

Certain features of the drawings in this application were required to be presented, at the time of filing, in color. Thus, this application file contains at least one drawing executed in color. Copies of the color drawings are maintained by the U.S. Patent Office and will be provided by the Office upon request and payment of the necessary fee.

In order that a more precise understanding of the above recited invention can be obtained, a more particular description of the invention briefly described above will be rendered by reference to specific embodiments thereof that are illustrated in the appended drawings. It should also be understood that the drawings presented herein may not be drawn to scale and that any reference to or indication of dimensions in the drawings or the following description are specific to the embodiments disclosed. Any variations of these dimensions that will allow the subject invention to function for its intended purpose are considered to be within the scope of the subject invention. Thus, understanding that these drawings depict only typical embodiments of the invention and are not therefore to be considered as limiting in scope, the invention will be described and explained with additional specificity and detail through the use of the accompanying drawings in which.

DETAILED DISCLOSURE

Figure 1:
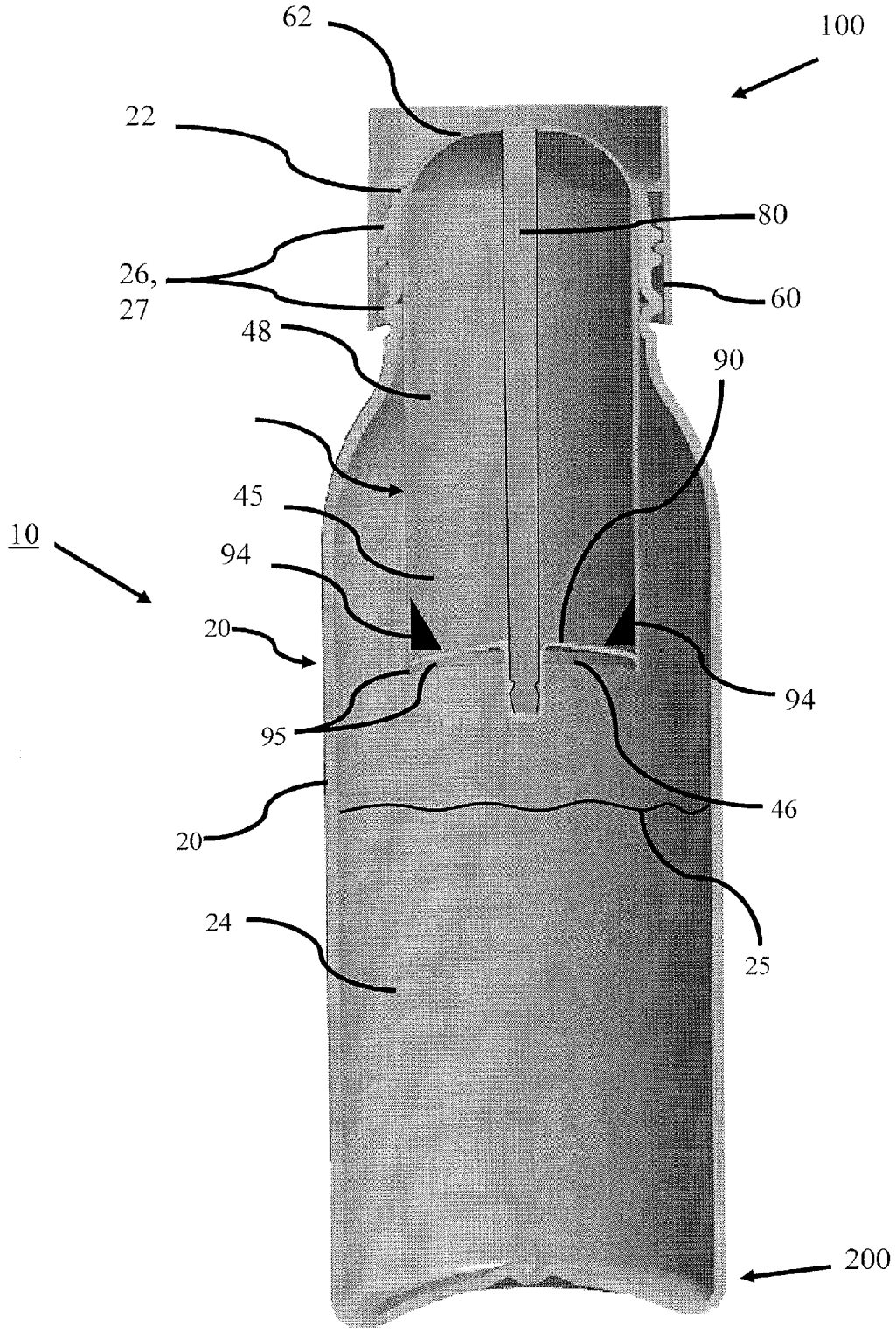
FIG. 1 illustrates a cut-away front elevation view of an embodiment of a container with an internal chamber of the subject invention.

The subject invention in general describes embodiments of a dispensing receptacle. More specifically, the subject invention pertains to one or more embodiment(s) of a container, or similar device, having an internal chamber capable of dispensing a secondary component to be combined with ingredient(s) in the container. Even more specifically, the subject invention pertains to a container having an interior chamber therein that is integrally attached and removable with the container closure mechanism.

The following description will disclose that the subject invention is particularly useful in the field of beverage containers, in particular beverage containers for long-term storage, and more particularly single-use beverage containers. However, a person with skill in the art will be able to recognize numerous other uses, both food and non-food related, that would be applicable to the devices and methods of the subject invention. Thus, while the subject application describes embodiments related to beverage or drink containers, other uses and related modifications therefor will be apparent to a person with skill in the art and having benefit of the subject disclosure. Such alternative uses and modifications, which are not inconsistent with the description herein, are contemplated to be within the scope of the present invention.

In the description that follows, a number of terms used in relation to dispensing receptacles and their contents are utilized. In order to provide a clear and consistent understanding of the specification and claims, including the scope to be given such terms, the following definitions are provided.

The term "container" as used herein can be applied to any receptacle used to hold or carry a material. Such container can be manufactured from any of a variety of materials known in the art, including, but not limited to, plastic, glass, metal, ceramic, rubber, plant materials, and composites or combinations thereof.

The term "consumable" as used herein refers to any material, edible or non-edible, that can be stored, held and/or carried within a container. Such material can be, by way of non-limiting examples, liquids, gels, powders, granules, solids, or combinations thereof A consumable can be pre-packaged within a container prior to consumer use. Conversely, the consumable can be a post-packaging addition to the container, that is, something added to the container at a later time or by a consumer.

As used herein, the term "secondary component" refers to any of one or more material(s), edible or non-edible, that can be stored, held, or carried within an interior chamber, and subsequently released into a container. Secondary components can be of any consistency such as, but not limited to, powders, pills, granules, liquids, gels, creams, foams, or any other material that can flow or move, particularly by force of gravity.

Also, as used herein, and unless otherwise specifically stated, the terms "operable communication," "operable connection," "operably connected," "cooperatively engaged" and or derivations thereof mean that the particular elements are connected in such a way that they cooperate to achieve their intended function or functions. The "connection" or "engagement" may be direct, or indirect, physical or remote.

Finally, reference is made throughout the application to the "distal end" and the "proximal end." As used herein, the distal end is that end typically considered the bottom of the container or that end on which the container rests. Conversely, the proximal end is that end typically considered to be the top of the container, usually near the opening of the container, or that part of the container furthest from the distal end.

The present invention is more particularly described in the following embodiments and examples that are intended to be illustrative only since numerous modifications and variations thereof will be apparent to those skilled in the art. As used in the specification and in the claims, the singular for "a," "an" and "the" include plural referents unless the context clearly dictates otherwise.

With reference to the attached figures, which show certain embodiments of the subject invention, it can be seen that the subject invention is, in general, a dispensing receptacle 10 having a container 20, an interior chamber 40, a closure mechanism 60, an actuator 80 and a sealing partition 90 that regulates the opening and closing of the interior chamber. As will be discussed herein, each of these components can have various embodiments and configurations.

With regard to the container, FIG. 1 illustrates one embodiment having a standard bottle-like configuration. In this embodiment, there is a single opening 22 at the proximal end 100 that communicates with the container cavity 24. The opening can also have one or more coupling features 26, such as, for example, continuous threading, ribbing, or pawls, for attaching a closure mechanism 60. In the embodiment shown in FIGS. 1-5, the container is a vertically-oriented bottle style, such that the height is greater than the width. Alternative embodiments can include any of a multitude of styles of bottles, cartons, cans, jars or the like, with differing dimensions, which are amendable for use with the subject invention. Further alternative embodiments, can utilize containers with more than one opening and/or openings within the bottle, such as, for example, two or more openings at the proximal end, or additional opening(s) on the sides or at or near the distal end 200. Thus, there can be a wide variety of containers useful for holding a consumable that can be used with the embodiments of the subject invention, e.g., cans, jars, cartons, and the like, as will be apparent to those skilled in the art. Such variations are contemplated to be within the scope of the subject invention.

In a specific embodiment, the container is a vertically-oriented 8 oz., 16 oz., 20 oz., or 32 oz. beverage bottle having a single opening at the proximal end for dispensing a liquid. In a still further specific embodiment, the height of the bottle can be between approximately 6.0 inches and approximately 9.0 inches. In a more specific embodiment, the height of the bottle is between approximately 7.5 inches and 8.5 inches. The size of the one or more openings in the bottle can also vary in diameter, shape and location. In a specific embodiment, the bottle has a single opening at the proximal end. In a further specific embodiment, the opening has a diameter of between approximately 20.0 mm and approximately 45.0 mm. In a more specific embodiment, the opening has a diameter of approximately 38.0 mm.

A closure mechanism 60 can be any of a variety of devices known to those with skill in the art, which are used to close a container opening. A closure mechanism can also have any of a variety of coupling structures designed to cooperatively engage with the opening, including, but not limited to, continuous threading, snap-on ribs, or the like. Many closure mechanisms known in the art are designed to be cooperatively engaged with one or more coupling features 26 on a container, so they can be removed from the container prior dispensing. Alternative embodiments can utilize more permanent closure mechanisms that are designed to remain on the container and are not typically or easily removable, such as, for example, one-way pawls, reverse-burr structures, or heat-sealed, crimped, or ultrasonic welded closures. Oftentimes, more permanent closure mechanisms can have a secondary opening that allows the contents of the container to be dispensed. They may also have a built-in release mechanism that, when activated, can allow the more permanent closure mechanism to then be removed. Pull tabs with release strips would be one example of a built-in release mechanism, known in the art.

Figure 2:
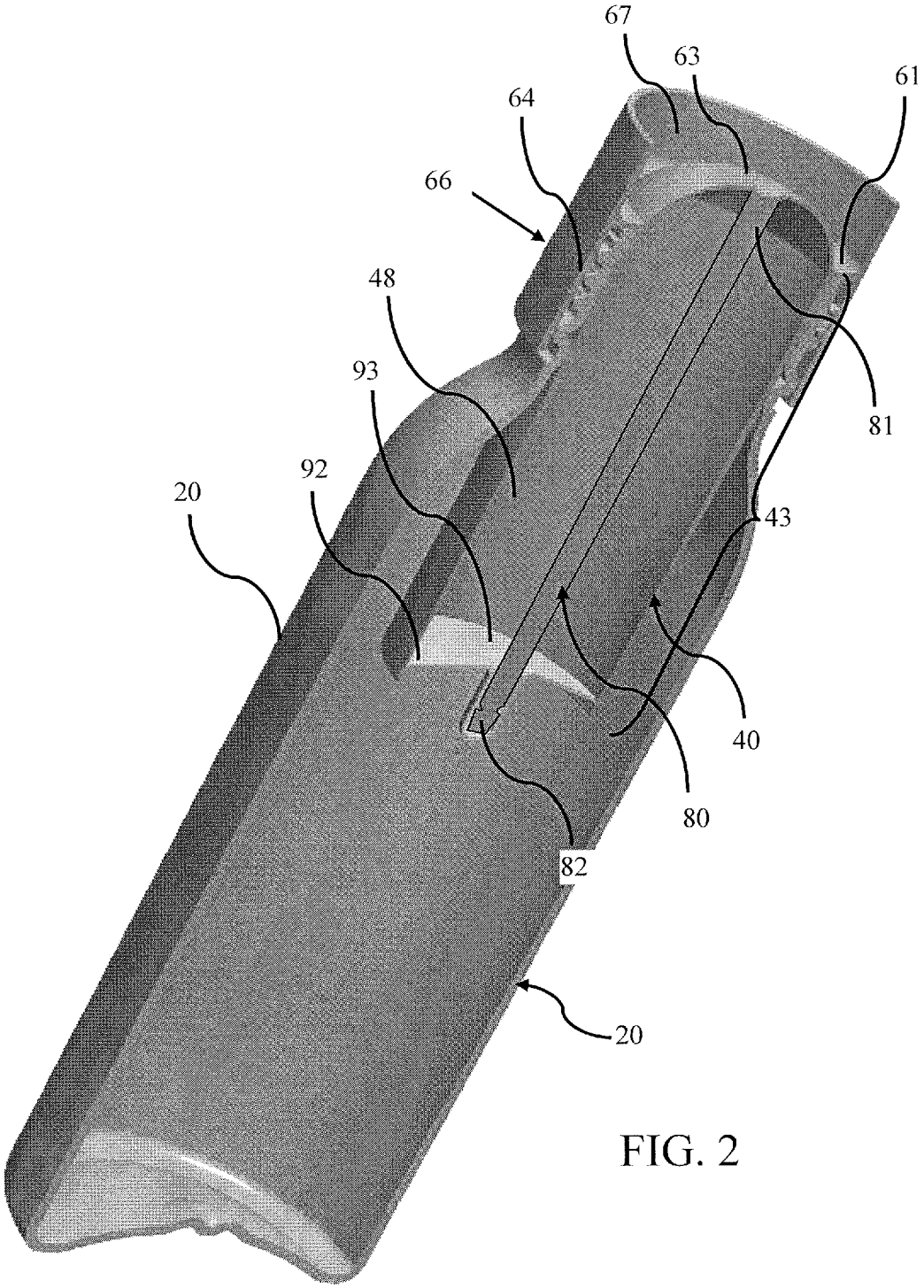
FIG. 2 illustrates a cut-away left front perspective view of the container embodiment.
Figure 3:
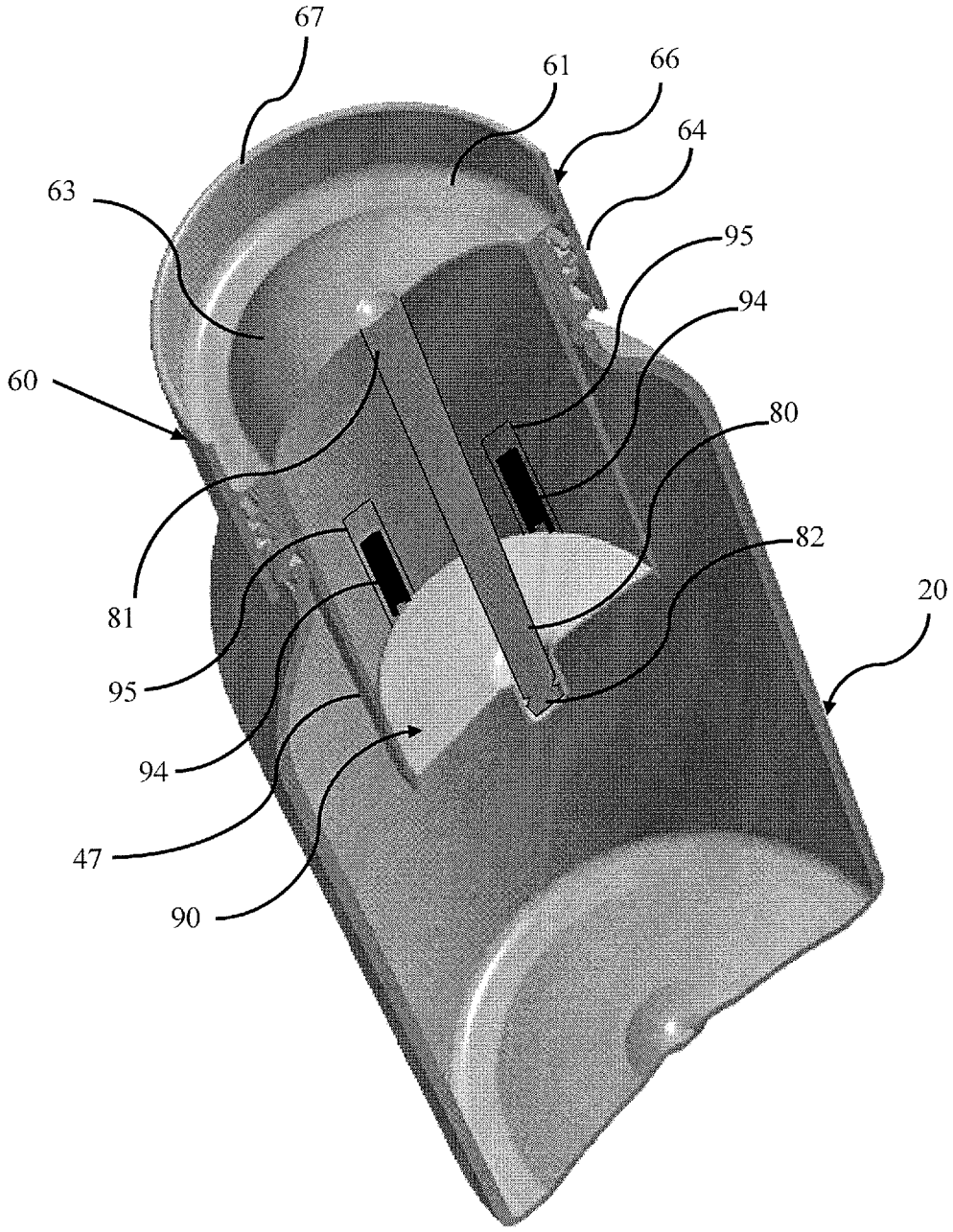
FIG. 3 illustrates a cut-away top perspective view of the container embodiment.
Figure 4:
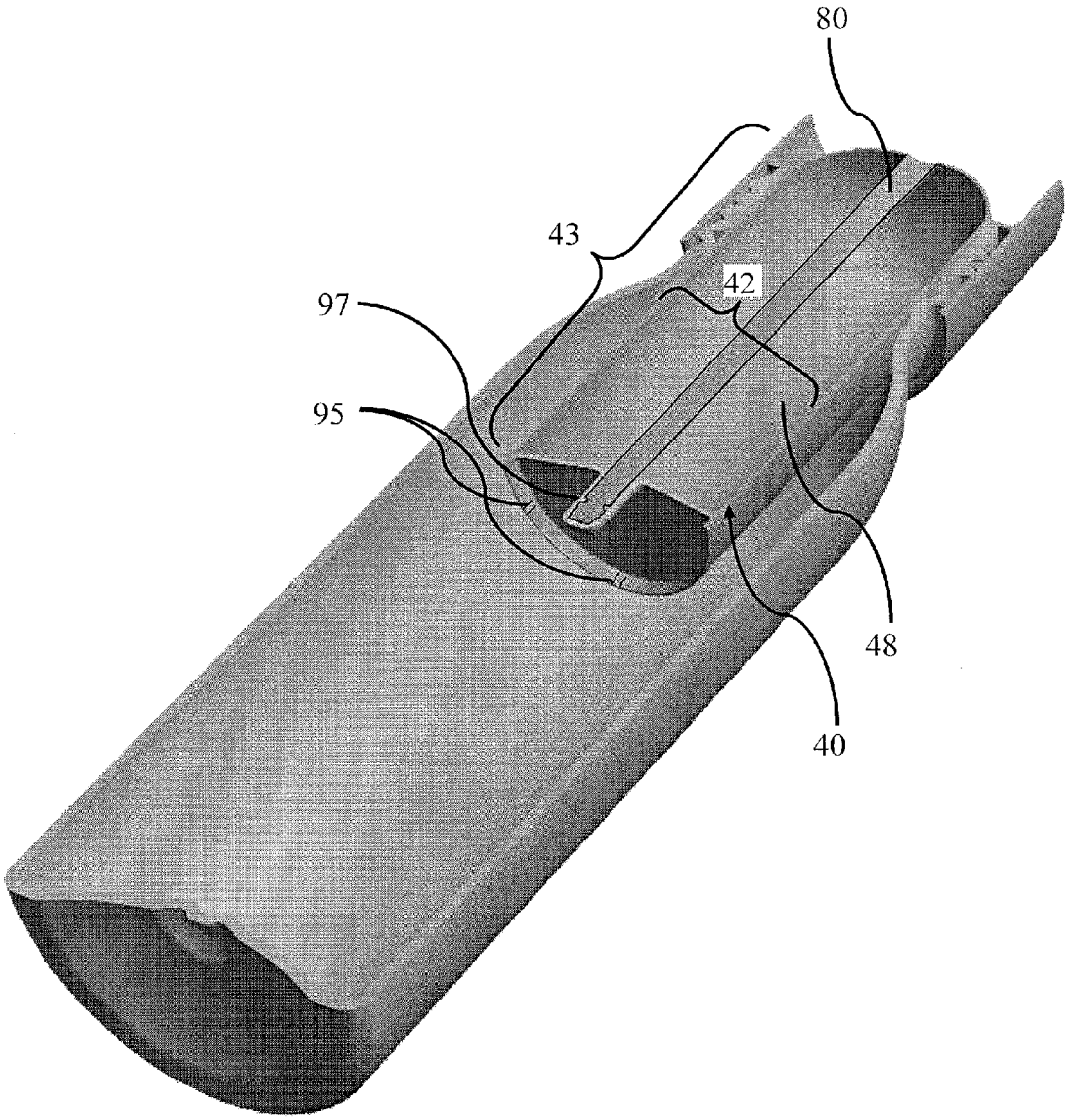
FIG. 4 illustrates a cut-away bottom perspective view of the container embodiment.

In one embodiment, the closure mechanism is a cap 66 comprised of a top cap wall 61 with a side skirt 64 that surrounds, or at least partially surrounds, and is contiguous with at least a portion of the periphery of the top cap wall, as shown for example in FIGS. 2 and 3. The top cap wall and the side skirt together can form a structure having a cup-like interior 65, shown, for example, in FIG. 9, designed to fit over a container opening 22. In a further embodiment, the interior side of the side skirt 64 can have one or more coupling features 26 that cooperatively engage with the opening of the container. Likewise, the opening of the container can also have coupling features 26 for engagement with the coupling features of the closure mechanism.

In a specific embodiment, the closure mechanism 60 is a removable, continuous thread (CT) cap that can couple with continuous threading around a container opening. In a more specific embodiment, the CT cap is configured for a container with a neck portion 23 having an approximately 38 mm opening 22 with continuous external threading 27.

The closure mechanism 60 can also include one or more secondary openings therein that can be used to dispense a consumable 25, allowing the closure mechanism itself to remain on the container. This can include such mechanisms as flip-top openings, pull-tab openings, twist openings, pop-up openings, or other types known to those with skill in the art. As will be described below, such secondary openings can be compatible with an interior chamber 40. Alternative embodiments and specific features of the closure mechanism 60 will be further discussed in conjunction with embodiments of the interior chamber 40. A person with skill in the art would readily recognize a diverse number of closure mechanisms that could be utilized with the embodiments of the subject invention. Substitution of closure mechanisms, other than those specifically described herein, are also contemplated to be within the scope of the subject invention, insofar as they do not detract from the overall operation of the embodiments of the invention.

The fundamental purpose of an interior chamber 40 is to dispense a secondary component 45 into a container. In one embodiment, the interior chamber 40 is located within the interior cavity 24 of the container. In a more particular embodiment, the entire interior chamber is located within the interior cavity of a container. Thus, the dimensions of the interior chamber can vary depending upon the size and configuration of the container interior cavity, the amount or type of secondary component to be contained therein, the amount or level of the consumable within the container, the material used to manufacture the interior chamber or components thereof, the type of actuator used, and other factors that would be understood by someone skilled in the art having benefit of the subject disclosure.

In general, an interior chamber is a walled partition within a container, where the wall 47 forms an interior bore 48. The secondary component 45 is contained or stored within the interior bore 48, as illustrated, for example, in FIG. 1. In one embodiment, the exterior diameter 42 of the interior chamber 40 is dependent upon the size of the container opening 22, such that, as will be described below, the interior chamber can be withdrawn from the container, through the opening 22. In a particular embodiment, the exterior diameter 42 of the interior chamber 40 is between approximately 25.0 mm and approximately 38.0 mm. The length 43 of the interior chamber can also vary depending upon a variety of factors. In one embodiment, the length 43 of the interior chamber is between approximately 2.0 cm and approximately 20.0 cm. However, in some situations, it can be advantageous if the secondary component 45 within the interior chamber 40 is released above the level of the consumable 25 within the container. This can be particularly important for dry or powder-like secondary components. In one embodiment, the length 43 of the interior chamber is between approximately 5.0 cm and approximately 10.0 cm. In a specific embodiment, the length of the interior chamber is approximately 7.0 cm.

In one embodiment, the interior chamber has dimensions or configurations that do not allow it to be removed from the container. Alternative embodiments can have an interior chamber with dimensions and/or configurations that do allow it to be removed, or at least partially removed, from a container through the opening 22. The interior chamber may also be configured with various shapes, colors, surface components, or other decorative or aesthetic characteristics.

In one embodiment, the interior chamber is coupled to the closure mechanism. In a further embodiment, mentioned above, the interior chamber can have dimensions or a configuration that allows it to be removed from the container when the closure mechanism is removed from the opening. In one embodiment, the interior chamber is integrated with the closure mechanism interior 65. More specifically, the proximal end 100 of the interior chamber 40 is joined to the interior of the top cap wall 61. Even more specifically, the proximal end 100 of the interior chamber wall 47 is fixedly attached to the interior 65 of the top cap wall 61. In this embodiment, an example of which is shown in FIGS. 1-5 and 9, the proximal end 100 of the interior chamber wall 47 encircles a portion of the top cap wall interior. With this embodiment, the interior bore 48 is a continuous cavity from the top cap wall to the outlet port.

In one embodiment, the interior chamber has dimensions and/or a configuration that allows it to be removable from a container, when the closure mechanism, e.g., a cap, is removed. In a further specific embodiment, the interior chamber is substantially tubular, such as shown, for example, in FIGS. 1-5. In this further specific embodiment, the exterior diameter 42 of the interior chamber is between approximately 2.0 cm. and approximately 4.0 cm. In a more specific embodiment, the exterior diameter 42 of the interior chamber is between approximately 2.9 cm and approximately 3.2 cm. This specific embodiment allows the interior chamber to fit within and be withdrawn from containers having a standard 38 mm opening 22.

To release a secondary component from the interior bore 48, the interior chamber can have one or more outlet ports 46 that can be opened and/or closed as necessary. An outlet port can be of any size or shape to accommodate the release of a secondary component from the interior chamber. Thus, an outlet port can be a hole, slit, cut-out or the like within the sides and/or bottom of the interior chamber. While the one or more outlet ports can be located anywhere on the interior chamber, it can be most advantageous for at least one to be located at or near the distal end, to allow all or most of the secondary component to be released, particularly when the container is in an upright position. However, depending upon the type and consistency of the secondary component the location of the outlet port(s) may be adjusted accordingly. Further, if the secondary component can be released with the container in an alternative position other than upright, then the location of outlet ports can be placed in advantageous location(s) to ensure proper and sufficient release of the secondary component.

Figure 8:
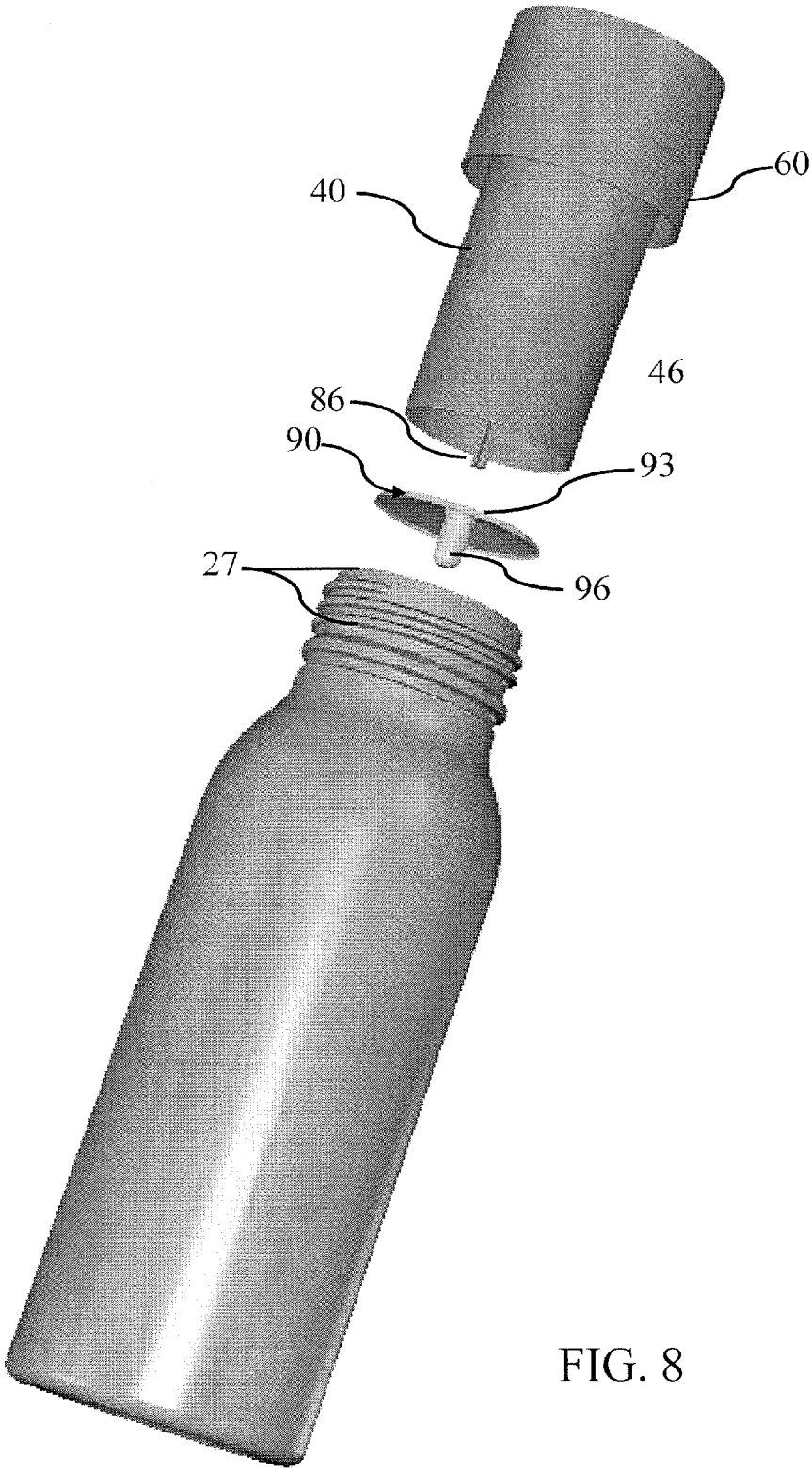
FIG. 8 illustrates an exploded perspective view of the container embodiment shown in FIG. 7. In this view, the outlet port and an actuator seat extending distally from the diaphragm can be seen.

In one embodiment, there is a single outlet port at the distal end of the interior chamber. In a more specific embodiment, an example of which is shown in FIG. 8, the entire distal end of the interior chamber is open to form one outlet port 46. In this embodiment, the wall 47 of the interior chamber is continuous and has no other openings therein other than the single, distal outlet port. Advantageously, the use of a single outlet port at the most distal end of the interior chamber can reduce or eliminate the possibility of secondary component remaining within the interior chamber. Further, if the secondary component does become temporarily caught or stuck, due to clumping or settling, a single tap on the closure mechanism or of the container bottom on a hard surface should suffice to cause the release of the secondary component.

In order to ensure that the secondary component is protected from, separated from, or otherwise segregated from the consumable 25 within the container, the outlet ports can be sealable. In one embodiment, the outlet ports are covered, plugged, or otherwise closed with one or more sealing partitions 90 that can be opened and/or closed as necessary. The sealing partition can be located on the outside, inside, or some combination thereof, of the interior chamber, but in any case should prevent contact between the secondary component 45 and the consumable 25. In one embodiment, the sealing partition 90 is a plug-like device that in operation fits into the outlet port.

In a particular embodiment, the partition 90 is a diaphragm 91 having a shape and configuration that matches or can conform to the shape of an outlet port. In a specific embodiment, illustrated for example in FIGS. 2, 8, 14, and 15, the diaphragm is designed to fit within an outlet port at, or about, the distal end 200 of the interior chamber 40. In this embodiment, the diaphragm can fit within and seal the outlet port, as shown in FIGS. 1-5, 11 and 14. In a further embodiment, the diaphragm is positioned within, or at about, the distal end of the interior chamber and the peripheral edge 92 contacts the interior chamber wall 47 to seal the outlet port. In a further embodiment, the peripheral edge can include a seal 98 that conforms to or otherwise cooperatively engages with the interior chamber wall 47. Alternatively, the peripheral edge can form a seal with the interior wall. It would be well within the skill of a person trained in the art to determine any of a variety of methods and devices for sealing the outlet port. Such variations are considered to be within the scope of the subject invention.

Figure 9:
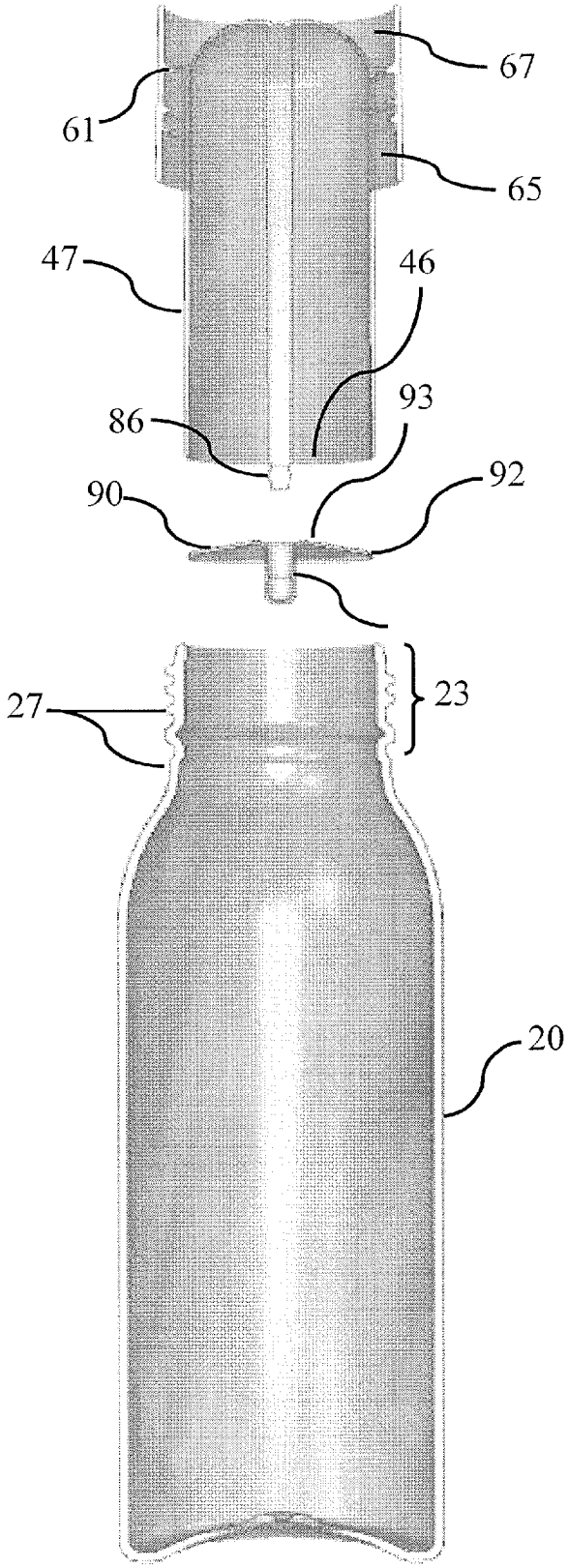
FIG. 9 illustrates an exploded cross-sectional view of the container embodiment.
Figure 10:
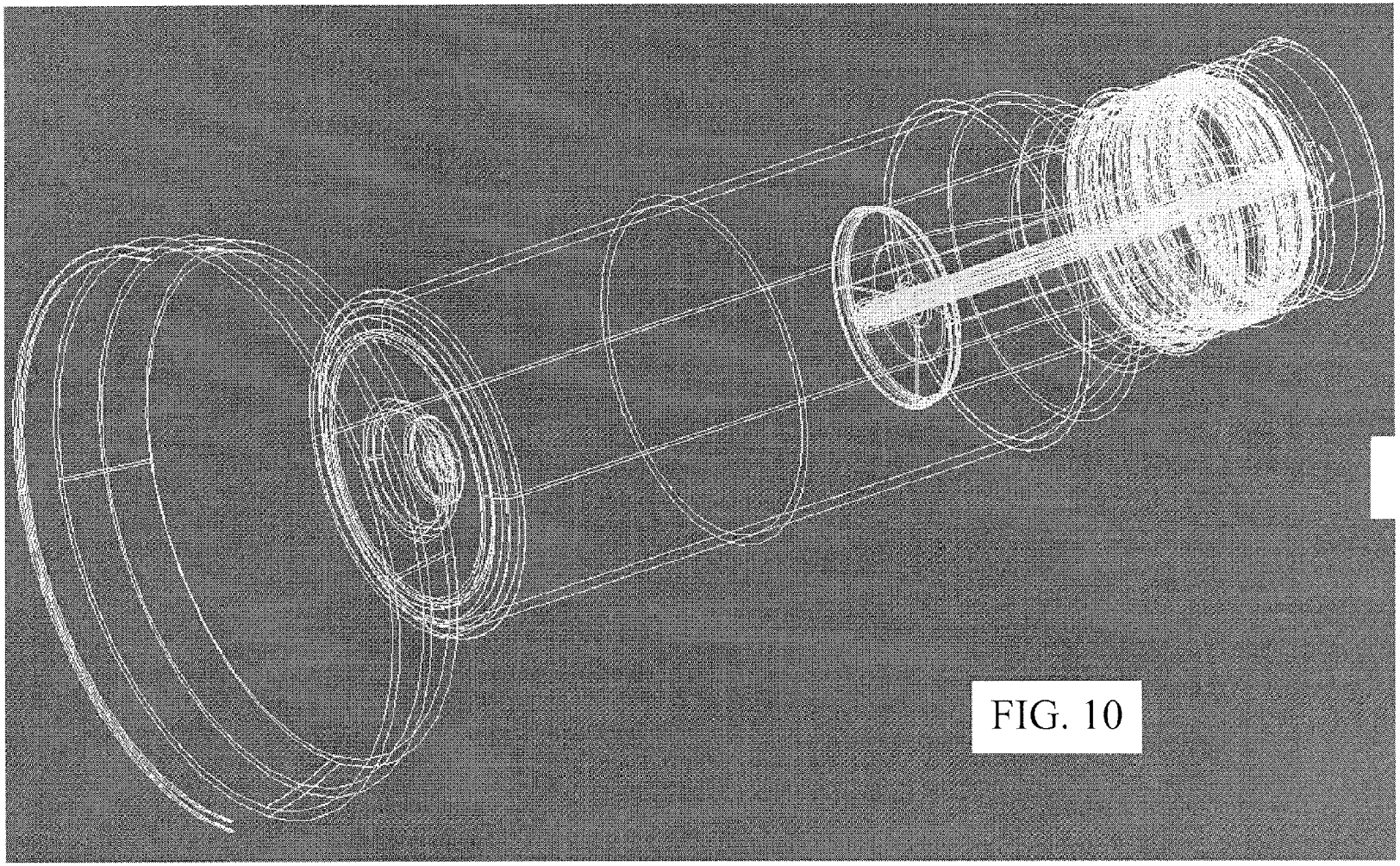
FIG. 10 illustrates a wire-frame image of a top left perspective view of the embodiment of a container with an internal chamber of the subject invention.
Figure 11:
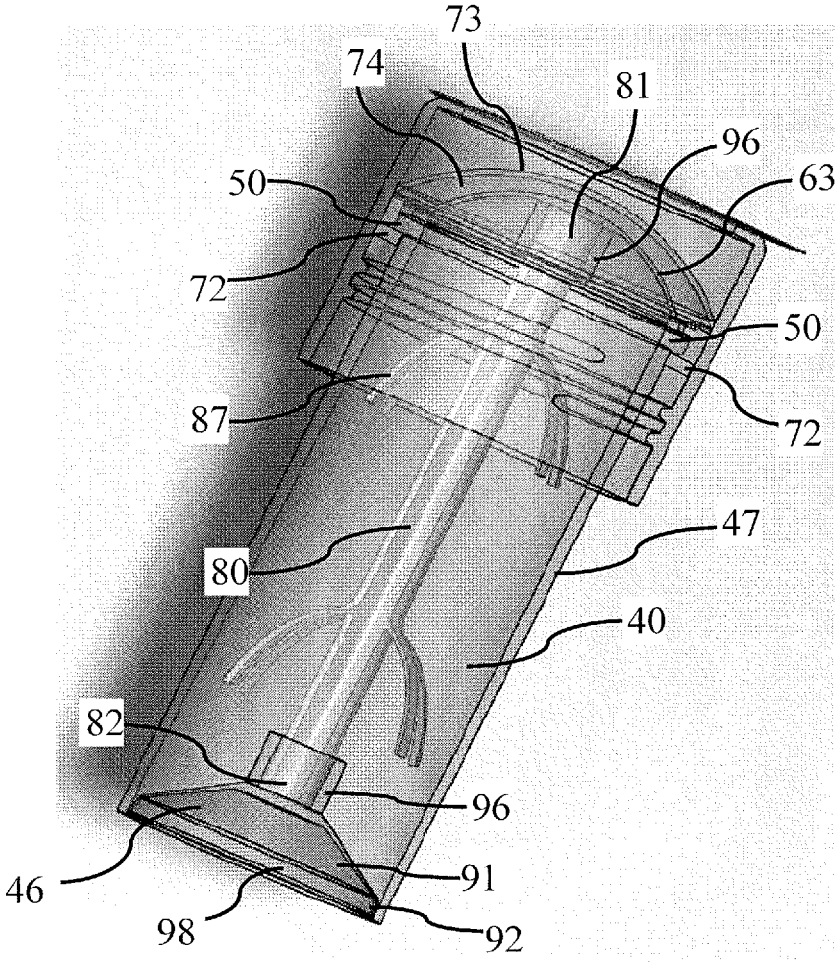
FIG. 11 illustrates a front elevation view of an alternative embodiment of the subject invention wherein the actuator is configured with multiple paddles that can assist in moving material out of the internal chamber when the actuator is pushed. In this embodiment, a disposable pull tab safety seal is removably attached to the proximal end of the guard wall. The diaphragm also has a different configuration in this embodiment.
Figure 12:
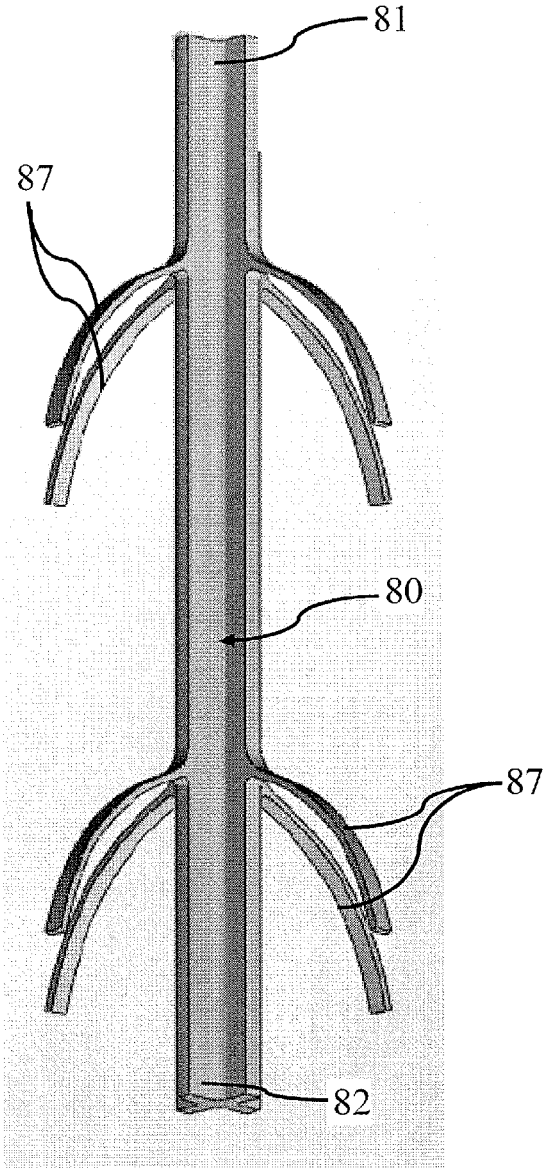
FIG. 12 illustrates a bottom perspective view of an embodiment of an actuator having multiple paddles attached.
Figure 15:
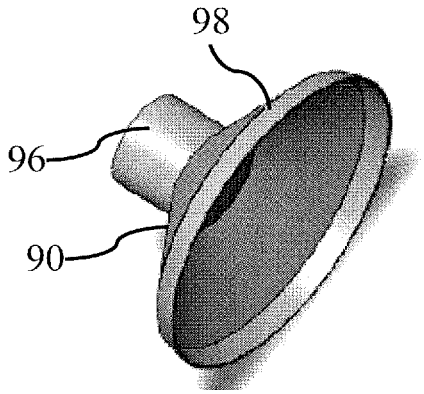
FIG. 15 illustrates a bottom perspective view of an alternative embodiment of a diaphragm.

To further facilitate the flow and release of secondary material, the diaphragm can have an arcuate shape, such as shown for example, in FIG. 9, or a more pyramidal shape, such as shown in FIGS. 11 and 15. The shape of the diaphragm can assist in directing the flow of material out and away from the outlet port, as illustrated, by way of example, in FIGS. 5, 9 and 11. In this embodiment, the peripheral edge 92 of the diaphragm is more distal than, or below, the crown 93 of the diaphragm.

In order to release a secondary component from the interior chamber through an outlet port, a sealing partition, such as, for example, a diaphragm can be removed or adjusted, so that it no longer covers or plugs the outlet port. More specifically, the diaphragm can be removed from the outlet port so that the secondary material can flow out of the interior chamber. This can be accomplished by any of a variety of devices and methods that directly or indirectly control the movement of the diaphragm. Regardless of the method used, it can be important to ensure that the diaphragm remains properly aligned within the interior chamber. In one embodiment, at least one guide rail 94 is utilized with the diaphragm to maintain alignment. In a more particular embodiment, two or more guide rails arc utilized to ensure alignment. In a more particular embodiment, multiple guide rails are utilized. FIG. 3 illustrates an example of this embodiment. In one embodiment, a guide rail is attached to the diaphragm and protrudes into the interior bore. In a further embodiment, at least some part of the guide rail has slidable or moveable contact with the interior chamber wall 47, such that the wall acts to guide and support the path of the guide rail. The use of two or more guide rails supported and guided by the interior bore 48 can ensure that the edge 92 of the diaphragm remains aligned and does not jam or lock against the interior bore. A guide rail can take the form of any of a variety of shapes, as long as it maintains contact with the diaphragm and the interior bore.

Figure 6:
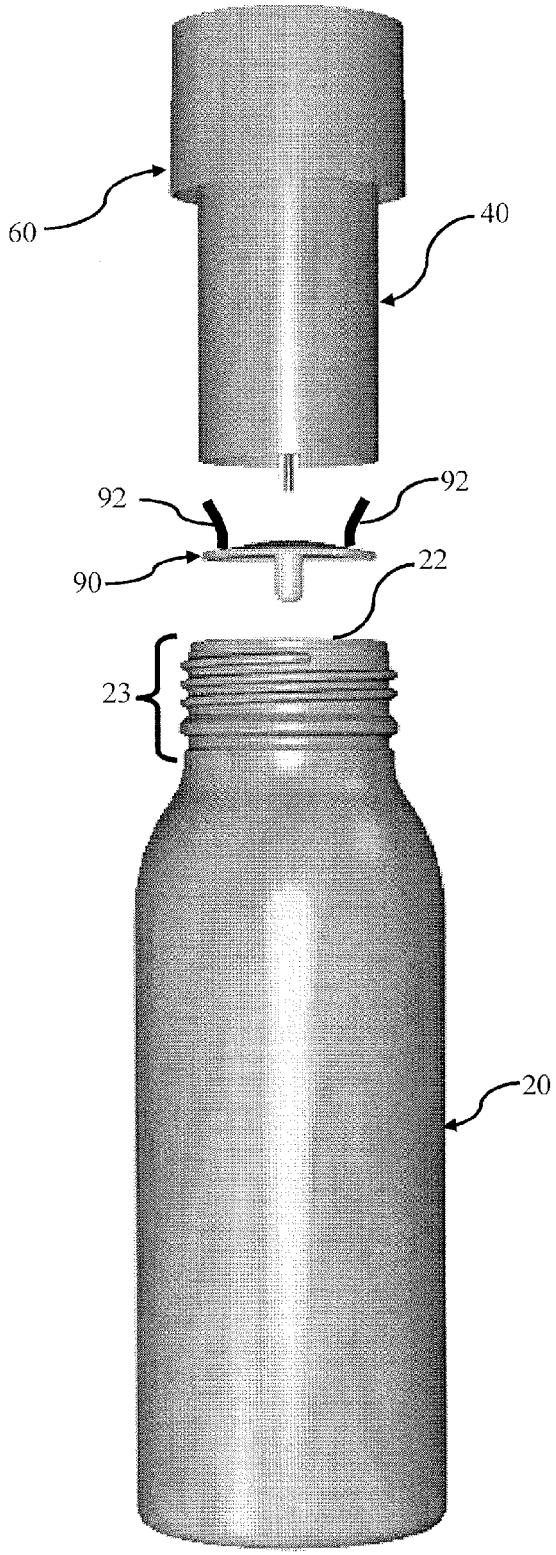
FIG. 6 illustrates an exploded front elevation view of the container embodiment shown in FIG. 1. In this view, the closure mechanism (cap) and internal chamber are shown separated from the container and the diaphragm separated from the actuator.

In a further embodiment, the interior chamber wall has one or more grooves or slots that provide guide rail tracks 95 along which the guide rails can slide. FIG. 1 illustrates an embodiment where a guide rail is in the form of a triangular gusset between the diaphragm and the wall 47 of the interior chamber. FIG. 3 illustrates an embodiment where a guide rail is a tab or rod that extends from the diaphragm, near the edge 92, protrudes into the interior bore and slides against the wall 47. FIG. 6 illustrates an embodiment where the guide rail is a rib that protrudes from the diaphragm and curves toward and contacts the wall 47.

It would be well within the skill of a person trained in the art to devise any of a variety of guide rail embodiments that could be used with the embodiments of the subject invention. Such variations are contemplated to be within the scope of the subject invention.

To control the operation of the sealing partition 90, there can be a control mechanism 62 on the exterior of the container that can operate the partition 90 for the outlet ports 46. More specifically, the control mechanism can operate the diaphragm within the outlet port 46. In one embodiment, the control mechanism is located on the outside of the container. By way of non-limiting example, the control mechanism can be a button, lever, knob, tab or other manually triggered device on the outside of the container. However, the control mechanism can be any of a variety of devices, and the type selected can depend upon the method of operation of the type of partition utilized. It would be well within the skill of a person trained in the art to devise any of a variety of control mechanisms other than those described here. Substitution of control mechanisms other than those exemplified herein are also contemplated to be within the scope of the present invention.

For the control mechanism to operate the sealing partition, it usually requires some contact with the partition. With these types of control mechanisms, an actuator 80 can be used as an intermediate between the control mechanism and the sealing partition. An actuator can be any object that can be manipulated with a control mechanism to cause motion of the sealing partition to open or close the outlet port. In one embodiment, the control mechanism is operatively engaged with an actuator 80 located on the inside of a container. In a further embodiment, a linear actuator is utilized to operably connect the control mechanism to a partition. In this embodiment, a first end 81 of the linear actuator is attached to the control mechanism, so that some movement of the control mechanism causes the linear actuator to move as well. In a still further embodiment, a second end 82 of the linear actuator is operably connected to a sealing partition 90, whereby movement of the linear actuator operates the sealing partition accordingly.

Any of a variety of actuators, linear and otherwise, known in the art can be utilized with the embodiments of the subject invention. Thus, it will be understood by a person skilled in the art, that the type of actuator used can depend upon several factors, including but not limited to, the type of control mechanism selected, the type of partition utilized, the location of the interior chamber, and other factors that would be understood by a person with skill in the art.

Figure 5:
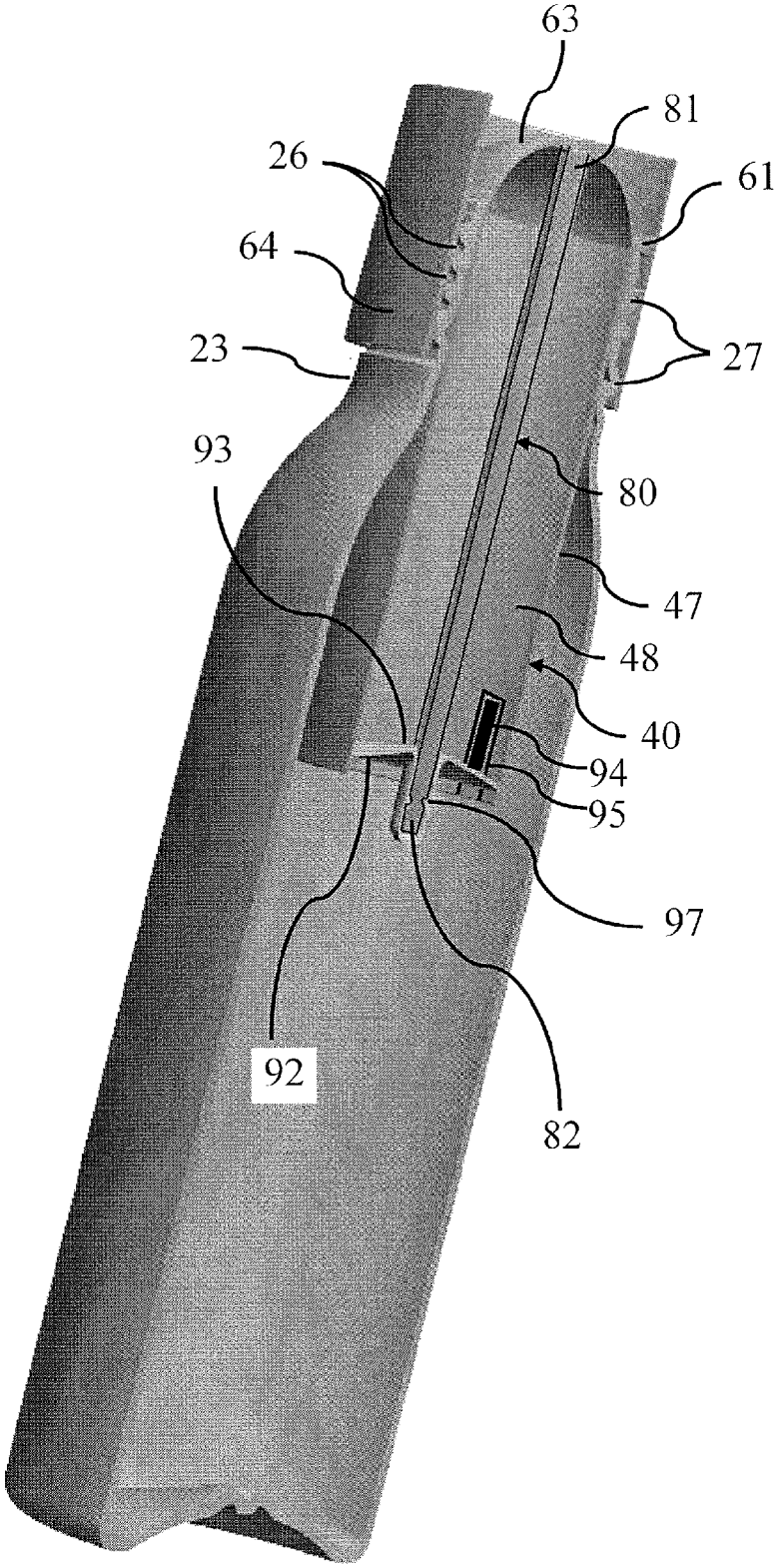
FIG. 5 illustrates a cut-away left side perspective view of the container embodiment shown in FIG. 1, inclined approximately 15°. In this figure, the linear actuator and diaphragm in position within the interior chamber can be seen.

In one specific embodiment, the control mechanism 62 is in the form of a push-button 63 or similarly pushable or pressable device positioned on the outside of a container 20. In a more specific embodiment, as shown in FIGS. 2, 3, and 5, the push-button is incorporated into or is formed as part of the closure mechanism 60. In this embodiment, the portion of the top cap wall 61 encircled by the wall 47 of the interior chamber, described above, can be raised above the level where the top cap wall and the side skirt 64 are joined. The raised portion of the top cap wall then forms a push-button control mechanism that can be pushed or pressed into the interior cavity. In one embodiment the push-button is formed from the same material as the closure mechanism. In an alternative embodiment, the push-button is formed from a different material than the closure mechanism. The height of the push-button above the level of the side skirt will depend upon several factors that will be more understood from the discussion below. But, in general, the height of the push button will depend upon the distance required to achieve effective movement of the sealing partition.

Figure 13:
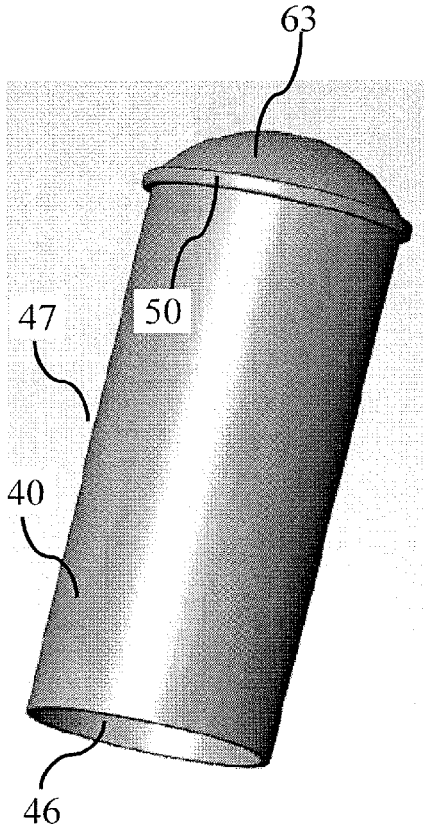
FIG. 13 illustrates a bottom perspective view of an alternative embodiment of and internal chamber with the push-button attached.

In an alternative embodiment, the push-button 63 control mechanism is formed as part of the interior chamber 40, such as shown, for example, in FIG. 13. In this embodiment, the push-button 63 is formed over the proximal end 100 of the interior chamber to seal the proximal end and to form an interior chamber/button combination 49. In this embodiment, the interior chamber/button combination can be a separate component from the cap. In a further embodiment, there is a collar 50 formed around the exterior of the interior chamber/button combination, which is also shown, for example, in FIG. 13. The collar 50 can be a single, continuous ridge encircling the interior chamber, as shown in the example in FIG. 13. Alternatively, the collar can be a series of multiple ridges or other protrusions arranged around the exterior surface of the interior chamber/button combination.

Figure 17:
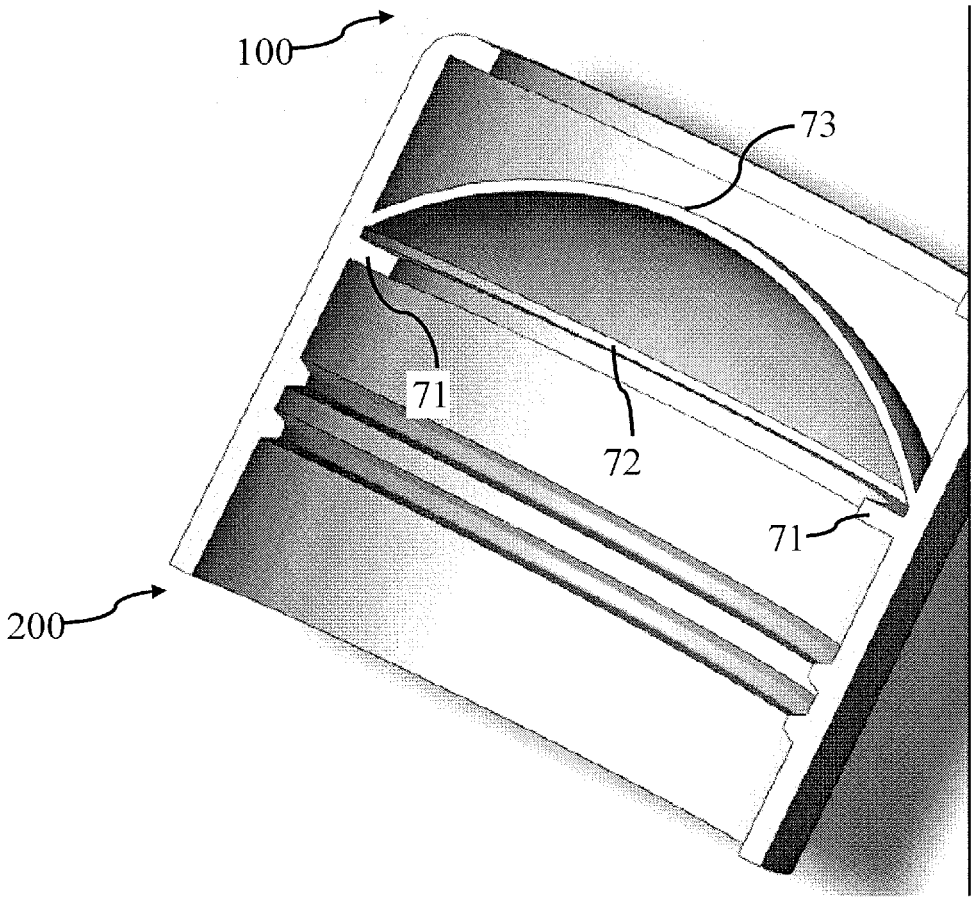
FIG. 17 illustrates a cross-sectional view of an alternative embodiment of a cap showing the configuration of a dome cover.

To engage the interior chamber/button combination 49 with the cap, the top cap wall 61, in an alternative embodiment, no longer forms a push button, but is reduced and instead forms a shelf 71 that circumscribes the interior of the cap 66, such as shown, for example, in FIG. 17. In one embodiment, the collar 50 engages with the shelf to secure the interior chamber/button combination within the cap. In a more specific embodiment, the interior chamber/button combination is inserted into the distal end 200 of the cap and pushed towards the proximal end 100 until the collar 50 is forcibly pushed past the shelf 71. This causes the collar 50 to be positioned on the proximal side of the shelf 71, so that the shelf edge 72, shown, for example, in FIG. 17, can have contact with the interior chamber wall 47. To facilitate the collar being pushed past the shelf, the collar can be made of one or more materials that have sufficient elasticity and/or flexibility to be sufficiently, forcibly deformed to go over the shelf edge 72.

Figure 14:
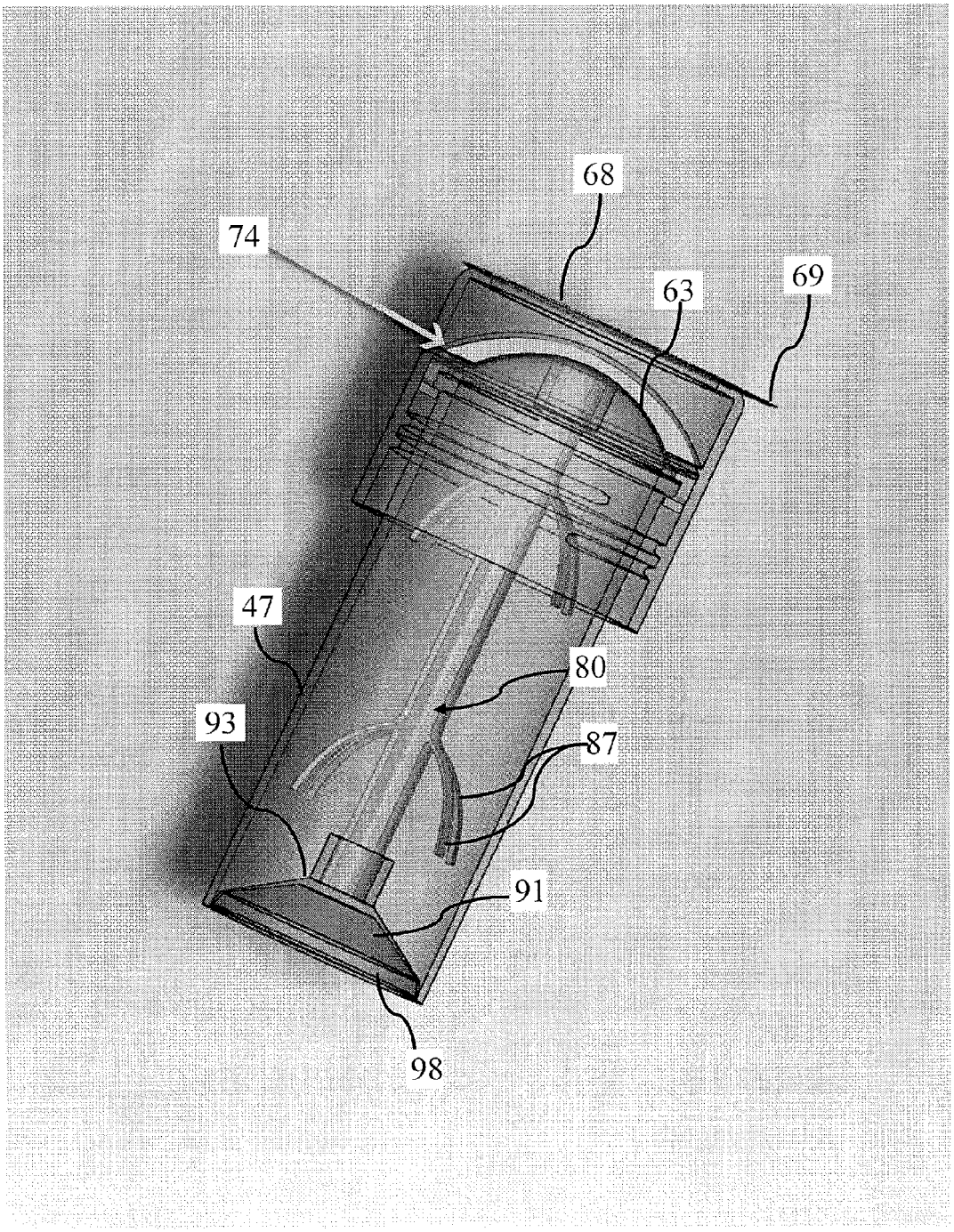
FIG. 14 illustrates a front elevation view of an alternative embodiment of the dispensing receptacle having a dome cover in the cap. The dome cover can create a void between the button cover and the push button, as indicated by the arrow.
Figure 16:
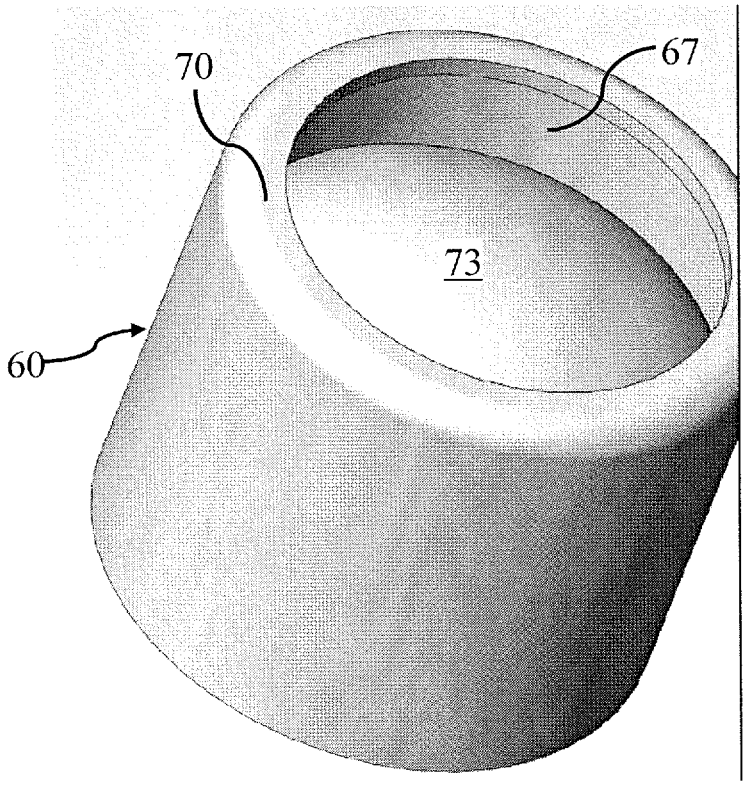
FIG. 16 illustrates a top perspective view of an alternative embodiment of a cap showing a dome cover therein.

In a further embodiment, a dome 73 is formed above the shelf 71 in the cap 66, such as shown, for example, in FIGS. 16 and 17. The shape of the dome can have a curvature that is similar to, or at least complimentary with, the shape of the push button on the interior chamber/button combination. With this embodiment, when the collar 50 on an interior chamber/button combination 49 is engaged with a shelf 71 in the cap, the dome will cover the push button. In a still further embodiment, the dome is disposed above the push button, so that there is a void 74, between the dome and the push button, an example of which is shown in FIGS. 11 and 14.

In a further embodiment, to engage the push button and release the secondary component 45, the dome 73 is first pushed or pressed until it contacts the push button 63. The dome can have a rigid or semi-rigid construction, such that a sufficient, but not an uncomfortable or difficult, amount of force can be applied when being pressed or pushed. The rigidity of the dome can ensure that the push button can only be deliberately engaged. The rigidity of the dome can further provide a clear indication, when pushed or depressed, that the push button has been engaged and the secondary component 45 has been released into the container 20. In a further embodiment, the dome has sufficient rigidity that, when depressed, it remains in the depressed position and does not return to an original position or "pop-up." This can ensure that the diaphragm remains open and that all the secondary component is released. The void 74 provides additional space for the dome to be slightly pressed before it contacts the push button, at which point the dome and the button can be pressed simultaneously. When the dome and the button are completely pressed, the dome will be sufficiently deformed that it can be maintain the deformed or pressed position, keeping the diaphragm open.

In some situations, it can be preferable for the interior chamber to remain open after the secondary component is released. This can require the control mechanism to remain in the activated position, so that the partition, or diaphragm, does not cover the outlet port. In one embodiment, the push-button, and/or the dome, is a one-way mechanism, such that, once pressed it remains in the pressed shape state, as described above. In other instances, it can be preferable for the interior chamber to be closed after the secondary component is released. This can require that the control mechanism have a two way operation to both open and close the partition. In an alternative embodiment, the push-button, and/or the dome, can be pushed or pressed into the interior cavity to open the partition, or diaphragm, but will automatically return to the unpressed position to pull the partition, or diaphragm back into the outlet port.

In one embodiment, a linear actuator is located within the interior chamber. In this embodiment, a first end 81 of the linear actuator is operatively connected to the interior of the top cap wall and a second end 82 of the linear actuator can be cooperatively engaged with the sealing partition 90. In a more specific embodiment, a first end 81 of the linear actuator is fixedly attached to the interior of the top cap wall that forms a push-button 63 and the second end 82 of the linear actuator is fixedly attached to a diaphragm 91. The operation of this specific embodiment is such that when the push-button 63 is pressed, the linear actuator 80 is simultaneously pushed towards the diaphragm 91, which in turn causes the diaphragm to be pushed out of the distal outlet port 46. If the actuator is configured with one or more paddles 87, they will also simultaneously push secondary material out of the chamber when the linear actuator is pushed towards the diaphragm. Once the partition is moved out of the outlet port, secondary component 25 can be released from the interior chamber.

In this specific embodiment, the attachment of the linear actuator to the push-button and the diaphragm is such that the components remain attached and do not disengage and fall into the container. Ideally, the attachment of the components does not affect their operation. In one embodiment, the attachment of the linear actuator to the push-button and/or the diaphragm is achieved by means of some type of adhesive joint, weld, or other seal between the first end of the linear actuator and the interior of the top cap wall that forms the push-button and the second end of the linear actuator and the diaphragm.

In an alternative embodiment, the push-button and/or diaphragm have structures thereon that can cooperatively engage with the first and second ends of the linear actuator, respectively. In one embodiment, the diaphragm has a seat 96 for receiving the second end 82 of the linear actuator. In a further embodiment, the push button is configured with a seat 96 for receiving the first end 81 of the linear actuator. In a still further embodiment, a seat has one or more coupling structures 97 that cooperatively engage with complementary coupling structures 86 on the linear actuator, such as shown, for example, in FIGS. 4 and 5. In a specific embodiment, the one or more seats on the push button and/or diaphragm have a reverse-burr configuration, wherein structures on the ends of the actuator are engaged with structures within the seat that allow an actuator end to be inserted, but not removed from, a seat. A person with skill in the art, having benefit of the subject disclosure, would be able to devise any of a variety of alternative seat embodiments for receiving and holding an actuator. It is contemplated that such variations are within the scope of the subject invention.

In one embodiment, shown, for example, in FIGS. 5, 7, 8 and 9, the seat on the diaphragm is located at or about the crown 93 of the diaphragm and extends distally 200. In this embodiment, the second end of the linear actuator, when placed in the seat, will be below the crown 93 of the diaphragm. In an alternative embodiment, the seat on the diaphragm is located at or about the crown 93 of the diaphragm and extends proximally 100, such as shown, for example, in FIGS. 11 and 14. FIGS. 11 and 14 also illustrate an example of an embodiment wherein the distal side of the push button 63 is configured with a seat 96 into which the first end of the linear actuator can be fixedly attached.

In the specific embodiment disclosed herein, for the linear actuator to be moved sufficiently that it can push the diaphragm 91 from the outlet port 46, the push-button 63 will need to have a sufficient height above the level where the top cap wall 61 joins with the skirt 64. In one embodiment, the height of the push-button is equivalent to the distance required to move the diaphragm a sufficient distance to disperse the secondary component. In an alternative embodiment, the height of the push-button is less than the distance required to move the diaphragm a sufficient distance to disperse the secondary component. In a still further alternative embodiment, the height of the push-button is greater than the distance required to move the diaphragm a sufficient distance to disperse the secondary component.

Some secondary components when stored will settle within a container and can be susceptible to compacting. This compacting can make it difficult for the secondary component to flow out of the internal chamber when the diaphragm is pushed from the outlet port. Therefore, it can be advantageous if there are one or more structures disposed within the internal chamber that can assist with breaking up compacted material and/or forcing it out of the internal chamber, when the outlet port is opened.

In one embodiment, the actuator 80 can have one or more structures that force the secondary component 45 out of the internal chamber when the diaphragm 91 is moved from the outlet port 46. In a more particular embodiment, a linear actuator 80 is configured with one or multiple paddles 87 that project from the linear actuator towards the wall 47 of the interior chamber. The paddles can be arranged in particular patterns or can be randomly placed on the linear actuator. The paddles can be rigid or semi-rigid. FIG. 11 illustrates an embodiment of a linear actuator with multiple paddles attached.

In a further embodiment, the paddles are flattened and/or widened along the distal side, to provide greater surface area contact with the secondary component. In a still further embodiment the paddles can be elongated and extend almost to, or can make contact with, the wall 47 of the internal chamber. FIG. 11 illustrates an embodiment of a linear actuator with multiple elongated paddles attached that extend towards the wall of the internal chamber. In a still further embodiment, the paddles curve towards the distal end of the internal chamber as they project from the linear actuator, such as also shown, for example, in FIG. 11.

In one embodiment, multiple paddles are arranged generally adjacent to each other in an approximately circular pattern projecting from the linear actuator. In a further embodiment, there is more than one row of push paddles arranged generally adjacent to each other in approximately circular patterns projecting from the linear actuator, such as shown, for example, in FIG. 11. In another embodiment, the push can be arranged in a spiral configuration along the length of a linear actuator. However, it should be understood that there can be any of a variety of paddle configurations on an actuator. A person with skill in the art having benefit of the subject disclosure and, perhaps, knowledge of the type of secondary component to be contained in the internal chamber, would be able to determine an appropriate number and configuration of paddles to use on an actuator. It is contemplated that such variations are within the scope of the subject invention.

Figure 7:
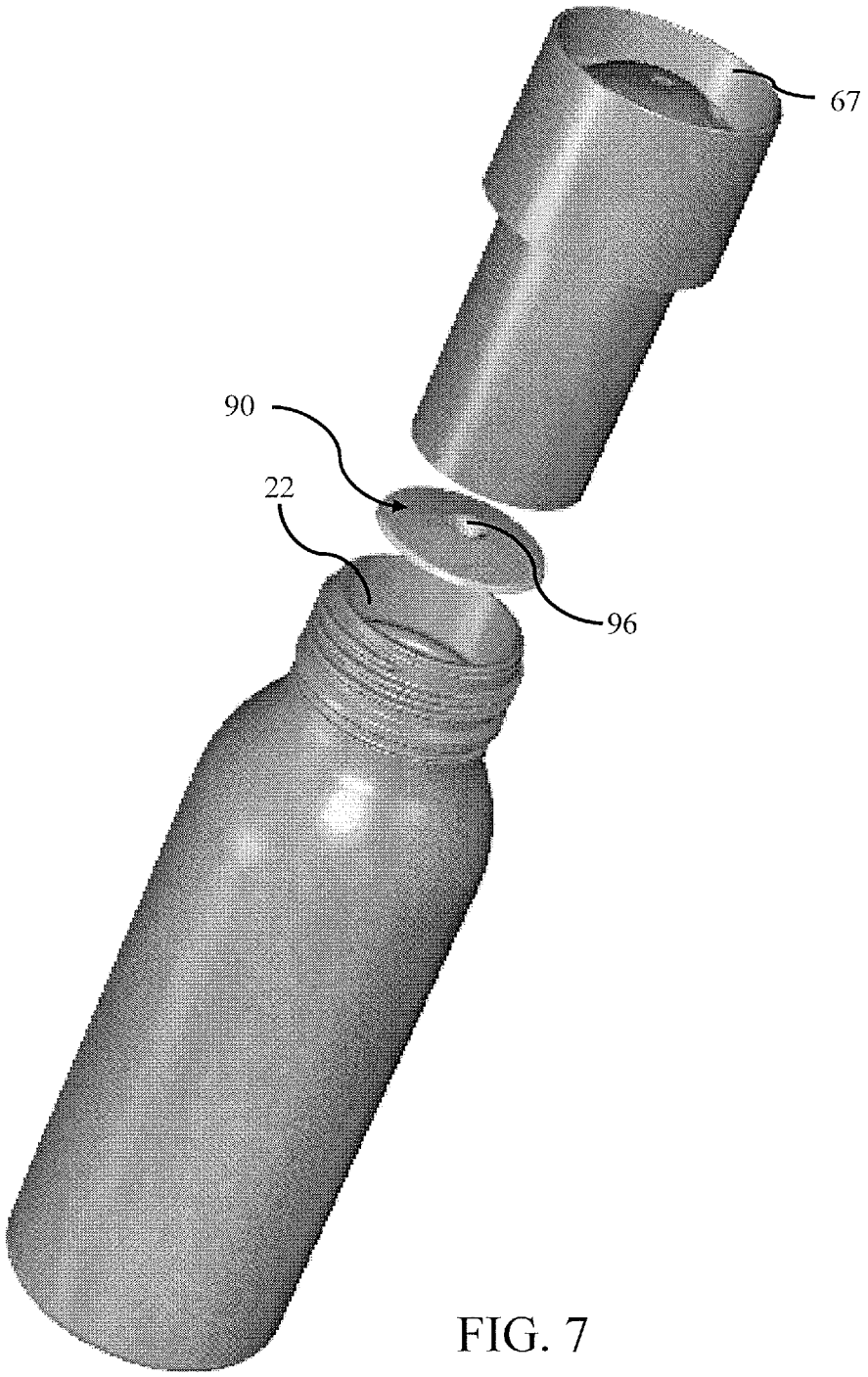
FIG. 7 illustrates an exploded left side perspective view of the container embodiment shown in FIG. 6.

In a further embodiment, the closure mechanism can include structures that prevent the accidental deployment of the push-button or other control mechanism. In one embodiment, the closure mechanism, or cap, has a guard wall 67 that surrounds a push-button on the top cap wall. The guard wall can be higher than a push-button or other control mechanism on the closure mechanism, so that the push-button or other closure mechanism cannot be accidentally contacted and deployed. FIGS. 3 and 7 provide examples of a guard wall 67 as utilized with particular embodiments of the subject invention.

It can also be advantageous, and even required for some products, to have tamper-proof or tamper-evident devices thereon. The use of tamper-proof or tamper-evident devices is well-known in the art and there are a myriad of devices and techniques in use for various purposes and products. The embodiments of the subject invention can include any compatible tamper-evident or tamper-proof seals known to those with skill in the art. In one embodiment, the guard wall 67 has a seal over the proximal end that would make it apparent if the container, cap, and/or push-button were altered or tampered with prior to use.

In a more specific embodiment, the guard wall has a paper or cardboard pull-off cover 68 over the proximal end of the guard wall, such as shown, for example, in FIG. 14. The pull-off cover 68 can protect the button 63 from being accidentally pushed. The pull-off cover can also act as a tamper-evident device by making it obvious whether the pull-off cover has been detached from the guard wall, punctured, torn or otherwise disturbed. In a further embodiment, the pull-off cover can include a tab 69 attached thereto, such as shown, for example, in FIG. 14, that can be grasped and pulled to remove the pull-off cover from the guard wall. In a still further embodiment, the guard wall 67 can have a generally horizontal lip 70, such as shown, for example, in FIG. 16, to which the pull-off cover 68 can be more easily attached.

The use of pull-off coverings and tabs attached thereto is well-known to those with skill in the art. A person with skill in the art would also be able to determine any of a variety of other types of tamper-proof or tamper-evident devices that could be used with the embodiments of the subject invention. It is contemplated that such alternatives would be within the scope of the subject invention.

It should be understood that the examples and embodiments described herein are for illustrative purposes only and that various modifications or changes in light thereof will be suggested to persons skilled in the art and are to be included within the spirit and purview of this application.

It should be understood that any reference in this specification to "one embodiment," "an embodiment," "example embodiment," "further embodiment," "alternative embodiment," etc., is for literary convenience. The implication is that any particular feature, structure, or characteristic described in connection with such an embodiment is included in at least one embodiment of the invention. The appearance of such phrases in various places in the specification does not necessarily refer to the same embodiment. Further, when a particular feature, structure, or characteristic is described in connection with any embodiment, it is submitted that it is within the purview of one skilled in the art to affect such feature, structure, or characteristic in connection with other ones of the embodiments.

The invention has been described herein in considerable detail, in order to comply with the Patent Statutes and to provide those skilled in the art with information needed to apply the novel principles, and to construct and use such specialized components as are required. However, it is to be understood that the invention can be carried out by specifically different equipment and devices, and that various modifications, both as to equipment details and operating procedures can be effected without departing from the scope of the invention itself. Further, it should be understood that, although the present invention has been described with reference to specific details of certain embodiments thereof and by examples disclosed herein, it is not intended that such details should be regarded as limitations upon the scope of the invention except as and to the extent that they are included in the accompanying claims.

I claim:

1. A dispensing receptacle comprising:

a container having an interior cavity and an opening that communicates the interior cavity to the exterior of the container;

a closure mechanism having a top cap wall contiguous with a side skirt and an exterior surface and an interior surface, wherein the interior surface of the side skirt has one or more coupling features for complementary attachment to the opening in the container, a flexible control mechanism integrated as part of the top cap wall, where the control mechanism is temporarily deformed during operation;

a sealable interior chamber comprising a continuous wall that extends from a first end to a second end with an interior surface and an exterior surface, wherein, the first end is fixedly attached and integral with the interior surface of the closure mechanism, such that the control mechanism is encompassed with the first end; and the second end extends into the interior cavity of the exterior housing, wherein the second end defines at least one outlet port;

a removable sealing partition positioned at or near the outlet port that seals the outlet port, and a linear actuator having a first end fixedly attached to the control mechanism and a second end fixedly attached to the sealing partition, such that operation of the control mechanism causes the line actuator to temporarily remove the sealing partition from the outlet port and where the control mechanism automatically returns the sealing partition to the outlet port when no longer deformed.

2. A dispensing receptacle according to claim 1, further comprising one or more guide rails fixedly attached to the sealing partition and having slidable contact with the interior surface of the sealable interior chamber.

3. A dispensing receptacle according to claim 1, wherein the closure mechanism is removable from the container.

4. A dispensing receptacle according to claim 3, wherein the closure mechanism is a continuous threading cap that couples with continuous threading on the container.

5. A dispensing receptacle according to claim 1, wherein the closure mechanism is not removable from the container.

6. A dispensing receptacle according to claim 4, wherein the control mechanism is a push button.

7. A dispensing receptacle according to claim 6, wherein the push button mechanism is raised above the level of the top cap wall.

8. A dispensing receptacle according to claim 7, further comprising a guard wall extending above the top cap wall that surrounds a push-button mechanism.

9. A dispensing receptacle according to claim 8, wherein the interior chamber can be removed from the dispensing receptacle with the closure mechanism.

10. A dispensing receptacle according to claim 9, wherein the second end of the interior chamber defines a single outlet port.

11. A dispensing receptacle according to claim 3, wherein the closure mechanism is a continuous threading cap that couples with continuous threading on the container.

12. A dispensing receptacle according to claim 11, wherein the control mechanism is a push button.

13. A dispensing receptacle according to claim 12, wherein the push button mechanism is raised above the level of the top cap wall.

14. A dispensing receptacle according to claim 13, further comprising a guard wall extending above the top cap wall that surrounds a push-button mechanism.

15. A dispensing receptacle comprising:

a container having an interior cavity and an opening that communicates the interior cavity to the exterior of the container;

a closure mechanism comprising, a side skirt having an exterior surface and an interior surface, a shelf circumscribing the interior surface of the side skirt, one or more coupling features on the interior surface of the side skirt for complementary attachment to the opening in the container, a dome disposed above the shelf, whereby, during operation, the dome is deformed, a sealable interior chamber comprising a continuous wall that extends from a first end to a second end having an interior surface and an exterior surface, wherein a flexible control mechanism integral with the first end, whereby, during operation, the control mechanism is deformed;

a collar that at least partially encircles the first end at or near the control mechanism, where the collar operably engages with the shelf in the closure mechanism, such that when the collar and shelf are operably engaged the interior chamber is fixedly attached to the closure mechanism and the dome covers the control mechanism;

a second end that extends into the interior cavity of the exterior housing, wherein the second end comprises an outlet port;

a sealing partition positioned at or near the outlet port that seals the outlet port, and a linear actuator having a first end fixedly attached to the control mechanism and a second end fixedly attached to the sealing partition, such that deforming of the dome and the control mechanism causes the linear actuator to remove the sealing partition from the outlet port and where the control mechanism, when not deformed automatically returns the sealing partition to the outlet port.

16. A dispensing receptacle according to claim 15, wherein the closure mechanism is removable from the container.

17. A dispensing receptacle according to claim 15, wherein the closure mechanism is not removable from the container.

18. A dispensing receptacle according to claim 16, wherein the interior chamber can be removed from the dispensing receptacle with the closure mechanism.

19. A dispensing receptacle according to claim 18, wherein the second end of the interior chamber defines a single outlet port.

20. A dispensing receptacle according to claim 19, wherein the sealing partition is a diaphragm.

21. A dispensing receptacle according to claim 15, further comprising one or more paddles projecting from the linear actuator.

22. A dispensing receptacle, according to claim 15, wherein the dome is flexible and, after being deformed, allows the control mechanism to return the sealing partition to the outlet port.

23. A dispensing receptacle, according to claim 15, wherein the dome is rigid or semi-rigid and, after being deformed, inhibits the control mechanism from returning the sealing partition to the outlet port.

24. A method for dispensing a substance into a container having a dispensing receptacle comprising:

a container having an interior cavity and an opening that communicates the interior cavity to the exterior of the container;

a closure mechanism comprising, a side skirt having an exterior surface and an interior surface, a shelf circumscribing the interior surface of the side skirt, one or more coupling features on the interior surface of the side skirt for complementary attachment to the opening in the container, a dome disposed above the shelf, whereby, during operation, the dome is deformed, a sealable interior chamber comprising a continuous wall that extends from a first end to a second end having an interior surface and an exterior surface, wherein a flexible control mechanism integral with the first end, whereby, during operation, the control mechanism is deformed;

a collar that at least partially encircles the first end at or near the control mechanism, where the collar operably engages with the shelf in the closure mechanism, such that when the collar and shelf are operably engaged the interior chamber is fixedly attached to the closure mechanism and the dome covers the control mechanism;

a second end that extends into the interior cavity of the exterior housing, wherein the second end comprises an outlet port;

a sealing partition positioned at or near the outlet port that seals the outlet port, and a linear actuator having a first end fixedly attached to the control mechanism and a second end fixedly attached to the sealing partition, wherein the method comprises, depressing the dome, depressing the control mechanism under the dome, causing the linear actuator to advance towards the sealing partition, so that the sealing partition moves away from the outlet port, wherein the control mechanism, when not depressed, automatically returns the sealing partition to the outlet port.

25. A method according to claim 24, further comprising removing the dispensing receptacle while simultaneously removing the closure mechanism from the container.

26. A dispensing receptacle, according to claim 24, wherein the dome is flexible and, after being depressed, allows the control mechanism to return the sealing partition to the outlet port.

27. A dispensing receptacle, according to claim 24, wherein the dome is rigid or semi-rigid and, after being depressed, inhibits the control mechanism from returning the sealing partition to the outlet port.

* * * * *